US005643164A

United States Patent [19]

Teff

[11] Patent Number: 5,643,164

[45] Date of Patent: Jul. 1, 1997

[54] LOWER EXTREMITIES EXERCISE BOARD

[76] Inventor: Joseph J. Teff, 1336 Stratford Ct., Middleton, Wis. 53562

[21] Appl. No.: 577,500

[22] Filed: Dec. 22, 1995

[51] Int. Cl.[6] ..... A63B 21/00

[52] U.S. Cl. ..... 482/146; 482/79; 601/28; 601/29

[58] Field of Search ..... 482/34, 51, 66, 482/79, 146, 142; 601/24–25, 29, 34; D21/191, 193

[56] References Cited

U.S. PATENT DOCUMENTS

| | | | |
|---|---|---|---|
| 1,981,379 | 11/1934 | Thomson et al. | 482/51 X |
| 3,361,427 | 1/1968 | Paves | 482/146 |
| 3,984,100 | 10/1976 | Firster | 482/146 X |
| 4,206,558 | 6/1980 | Bivona | 482/51 X |
| 5,203,279 | 4/1993 | Eversdyk | 482/146 X |

*Primary Examiner*—Richard J. Apley
*Assistant Examiner*—David R. Risley
*Attorney, Agent, or Firm*—Lathrop & Clark

[57] ABSTRACT

A rectangular board has support surface with two spaced apart parallel arcuate rockers. Each rocker has a flat portion adjacent to one edge of the rocker board. The flat portion makes an angle of approximately 45° with the upper surface of the board. A hemispherical pedestal or projection is formed between the two rockers on the underside of the board. The board has structure to assist in the performance of multiple exercises. A person standing on the board may hold the upper portion of the body in a substantially vertical position, with the lower extremities of the body then following the board back and forth as it rocks. In a second exercise, the board is held so the flat portion of the rocker holds the upper surface of the board at an angle of approximately 45° to the ground. The user's toes are placed on the ground with the heels extended up the 45 degree ramp until the ankle joints are stretched. Similarly, the heels of the feet may be placed on the ground with the toes placed in the upward position. When the board is turned upside down the rockers extend into the air and the hemispherical projection or post is exposed. The arch of the foot may be placed over the hemisphere and weight gradually applied to the foot causing the foot to assume an arcuate shape which stretches the tendons and muscles of the foot.

4 Claims, 4 Drawing Sheets

LOWER EXTREMITIES EXERCISE BOARD

FIELD OF THE INVENTION

The present invention relates to exercise equipment in general and to rocker mounted exercise boards in particular.

BACKGROUND OF THE INVENTION

Strength and flexibility of the lower body are important to everyone. Strength and flexibility in the feet, ankles, knees, thighs and hips can reduce the possibility of injury or strain from engaging in various sporting activities. On the other hand, to those who have suffered an injury to the lower extremities, a program of exercise which both strengthens and improves joint mobility can be critical in recovering full use of the extremities and in preventing recurrence of ankle, knee and joint strains and injuries.

Those involved in sporting activities, for example skiing, biking, roller blading, ice skating, etc., have long known of the benefits of warmup and other stretching exercises to reduce the possibility of injury by imparting greater strength and mobility, particularly with respect to the lower extremities of the body.

Tendons, the connective structures of the body, link together the various bones and joints within the body. Muscles provide the motive power for the joints. Muscles can be strengthened by exercise and tendons can be lengthened by repeated stretching. Greater muscular strength allows the body to resist excessive motion between bodily joints. Increased flexibility or tendon length allows a greater range of movement of the joints before damage is sustained by the body.

A full range of motion of the joints of the lower extremities is extremely important to mobility which, in turn, has a major impact on the quality of life. For those who have suffered injuries which interfere with mobility there is a very real need to recover the mobility. Such recovery of mobility can often be achieved through exercise which builds joint strength and flexibility.

One exercise device which is known for exercising the lower extremities consists of a board supported on two rockers. The exercise is performed by standing on the board while grasping a stationary object and rocking back and forth on the board. Thus, the upper portion of the body is held substantially vertical while the lower portion of the body conforms to the inclined surface produced by the board rocking back and forth. The orientation of the body with respect to the direction of rocking may be varied so the joints of the lower extremities receive a full range of motion.

Existing boards with rockers are not specifically designed to increase the range of motion of joints. Particularly, they do not provide a means whereby the maximum extent of the joints may be approached gradually and the joint held in that position of maximum extension for a period of time.

What is needed is an exercise device for extending the range of joint motion.

SUMMARY OF THE INVENTION

The exercise board of this invention employs a rectangular support surface with two spaced apart parallel arcuate rockers. Each rocker has a flat portion adjacent to one edge of the rocker board. The flat section makes an angle of approximately 45° with the upper surface of the board. Between the two rockers, on the side of the board opposite that which a person using the board stands on, a hemispherical pedestal or projection is formed. In use the board performs three functions. The first function involves the person standing on the board and holding the upper body portion in a substantially vertical position by holding on to a stationary object. The lower extremities of the body then follow the board back and forth as it rocks, exercising and stretching the joints of the lower extremities. To make use of the board's second function, the board is held so the lower, flat portion of the rocker holds the upper surface of the board at an angle of approximately 45° to the ground. In exercising, the user's toes are held on the ground and the heels are extended up the 45 degree ramp until the ankle joints are stretched to the maximum extent. This position is then held for a minute or so. Similarly, the heels of the feet may be placed on the ground with the toes placed in the upward position. The third function performed by the board occurs when the board is turned upside down so the rockers extend into the air and the hemispherical projection or post is exposed. The arch of a foot is then placed over the hemisphere and weight is gradually applied to the foot causing the foot to assume an arcuate shape which stretches the tendons and muscles of the foot.

It is an object of the present invention to provide an exercise device for improving strength and mobility of the joints of the lower extremities.

It is another object of the present invention to provide an integrally formed means with the board for stretching the muscles and tendons of the foot.

It is a further object of the present invention to provide an exercise device which may be used to create an inclined plane for providing maximum stretch of the ankle joint in a controlled fashion.

It is a further object of the present invention to provide an exercise board with an upper surface with a high coefficient of friction.

Further objects, features and advantages of the invention will be apparent from the following detailed description when taken in conjunction with the accompanying drawings.

DESCRIPTION OF THE PREFERRED EMBODIMENT

Figure 1:
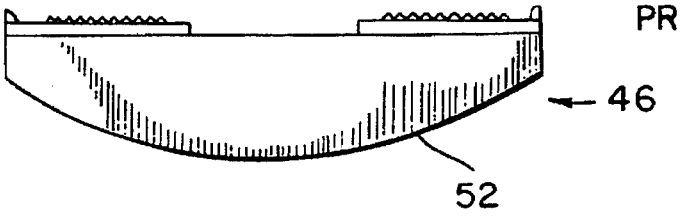
FIG. 1 PRIOR ART
FIG. 1 is a side elevational view of a prior art rocker mounted exercise board as shown in U.S. Design Pat. No. 227,584.

Referring more particularly to FIGS. 1–12, wherein like numbers refer to similar parts, a rocker mounted exercise board 20 is shown in FIGS. 4–12. The exercise board 20 is constructed of a generally planar board 22 which is mounted for rocking motion on two side rockers 24. The board 22 is longer than it is wide, thus defining two long edges 26 and two short edges 28.

Figure 5:
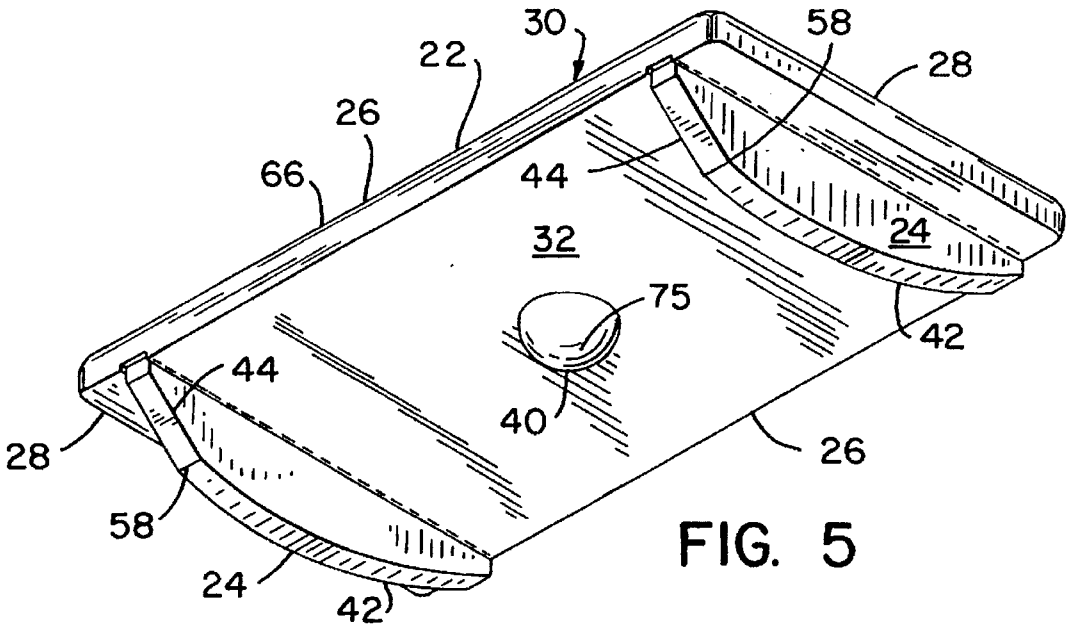
FIG. 5 is a bottom isometric view of the rocker board of FIG. 4.
Figure 6:
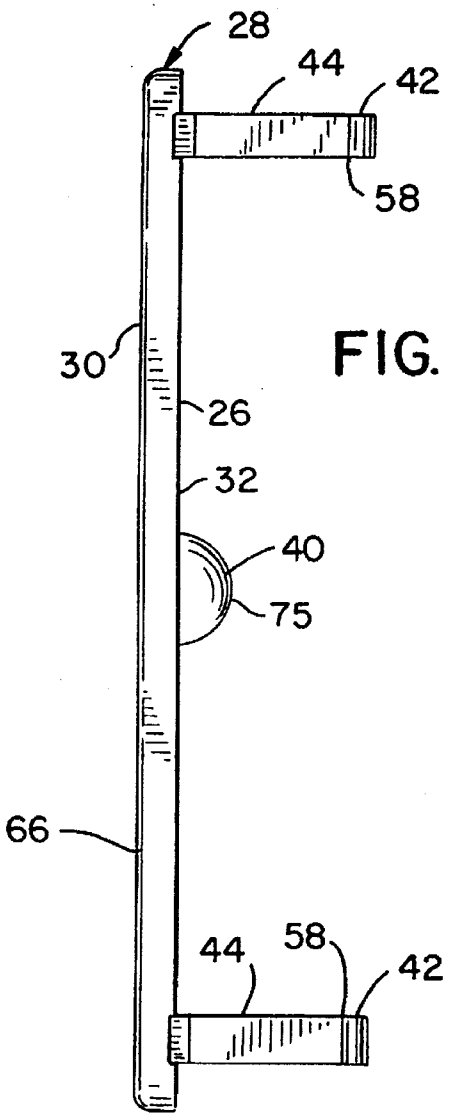
FIG. 6 is a front elevational view of the rocker board of FIG. 4.
Figure 12:
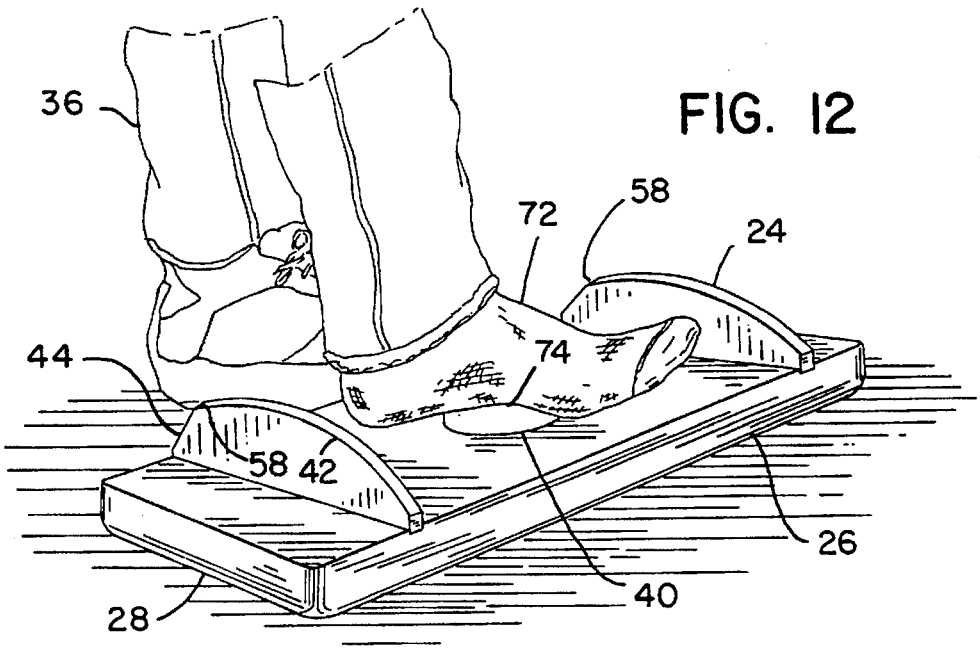
FIG. 12 is an isometric illustrative view of the rocker board of FIG. 1 showing a stretching exercise.

The rockers 24 extend between the long edges 26 and are spaced adjacent to the short edges 28. The board has a top surface 30 and a bottom surface 32. The top surface 30 forms a planer support and is designed to be stood upon when exercises using the exercise board 20 are performed. In order to increase the frictional contact between the shoes 34 of a person 36 performing exercises and the board 20, a high friction coating 38 is applied to the top surface 30. The high friction coating may consist of grit embedded in a paint which covers the upper surface 30 of the rocker 20. A hemispherical projection 40 is mounted to the lower side 32 of the board 22, as shown in FIGS. 5, 6, and 12.

Each rocker 24 has a lower profile formed of a smooth arcuate portion 42 and a flat portion 44. The lower profile includes the smooth arcuate portion 42 and the flat portion 44 of the rocker 24. The lower profiles are in spaced parallel relation to each other. The arcuate portion 42 defines an arc of a circle and has a radius of curvature of about one and a half times the length of the short edge 28 of the board 22.

An exemplary board will have a width of eleven inches and a length of 18 inches with a maximum height of the rockers 24 extending about 3¼ inches from the lower surface 32. The flat portion 44 of each rocker 24 forms an angle of approximately 45° with the upper and lower sides 30, 32 of the board 22.

Figure 2:
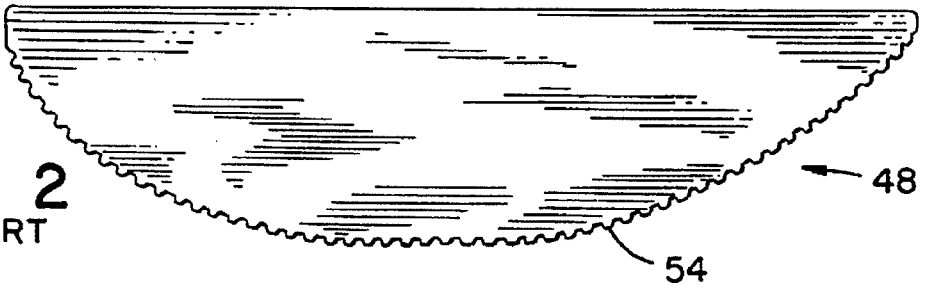
FIG. 2 PRIOR ART
FIG. 2 is a side elevational view of a prior art rocker mounted exercise board shown in U.S. Design Pat. No. 319,084.
Figure 3:
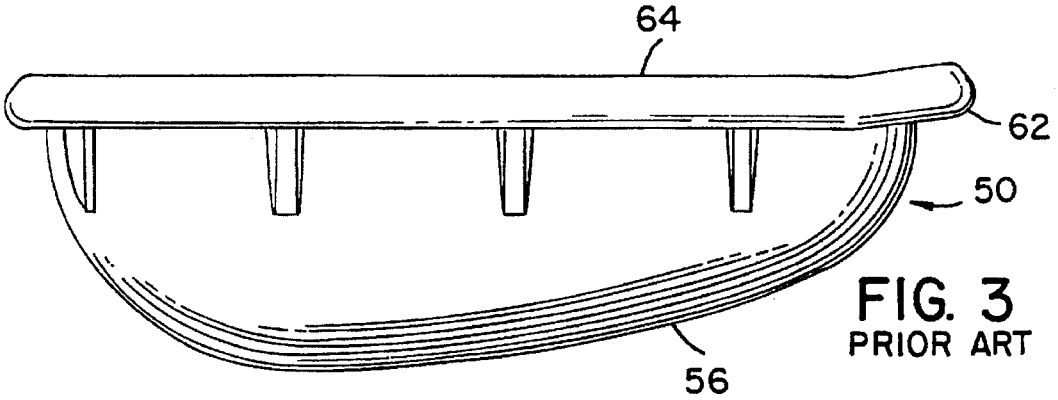
FIG. 3 PRIOR ART
FIG. 3 is a side elevational view of a prior art balance board as shown in U.S. Pat. No. 5,048,823.
Figure 4:
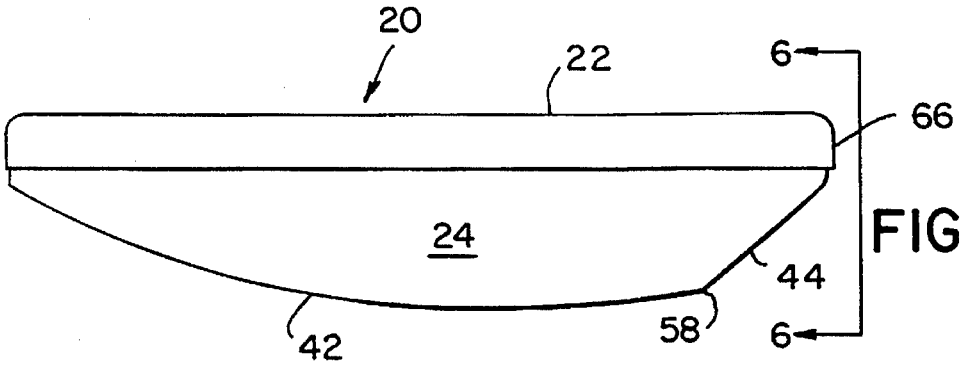
FIG. 4 is a side elevational view of the rocker mounted exercise board of this invention.

Prior art rocker boards 46, 48 and 50 are shown in FIGS. 1, 2, and 3 respectively. The prior art boards have rocker bottoms of varying shape. However, with prior art rocker boards, the rocker bottoms 52, 54, and 56 define continuous curves which provide continuous rocking motion between extreme positions of the boards 46, 48, and 50. As shown in FIG. 4 the rocker 24 of the exercise board 20 of the present invention has a discontinuity or ridge 58 between the smooth arcuate portion 42 and the flat portion 44. This discontinuity 58, in combination with the flat portion 44, provides a level of stability in terms of positioning the board at an angle of about 45° with respect to the floor or flat surface 60, as illustrated in FIGS. 9 and 10.

The prior art rocker board 50 of FIG. 3, which is illustrative of the rocker board of U.S. Pat. No. 5,048,823, has a rocker undersurface 56, which, in combination with the edge of the board 62, can hold the board's surface 64 at an angle of approximately 45° with respect to the ground. However, because the bottom surface 56 is smoothly curved the board 50 will inherently rock into and out of the 45 degree inclined position of the board. On the other hand, the board 20 of this invention, as shown in FIGS. 9 and 10, as a result of the discontinuity 58 and the edge 66, will result in a more stable positioning of the board at an angle with respect to the floor 60.

U.S. Pat. No. 3,361,427 to Paves discloses an exercise board wherein a polygonal rocker has a flat surface which defines, with the edge of the board, a stable position of the board wherein the upper surface of the board is angled approximately 30° to the floor. The polygonal rocker does not have a smooth arcuate portion for rocking in-line with the flat positioning surface.

Figures 7, 8, 9, 10:
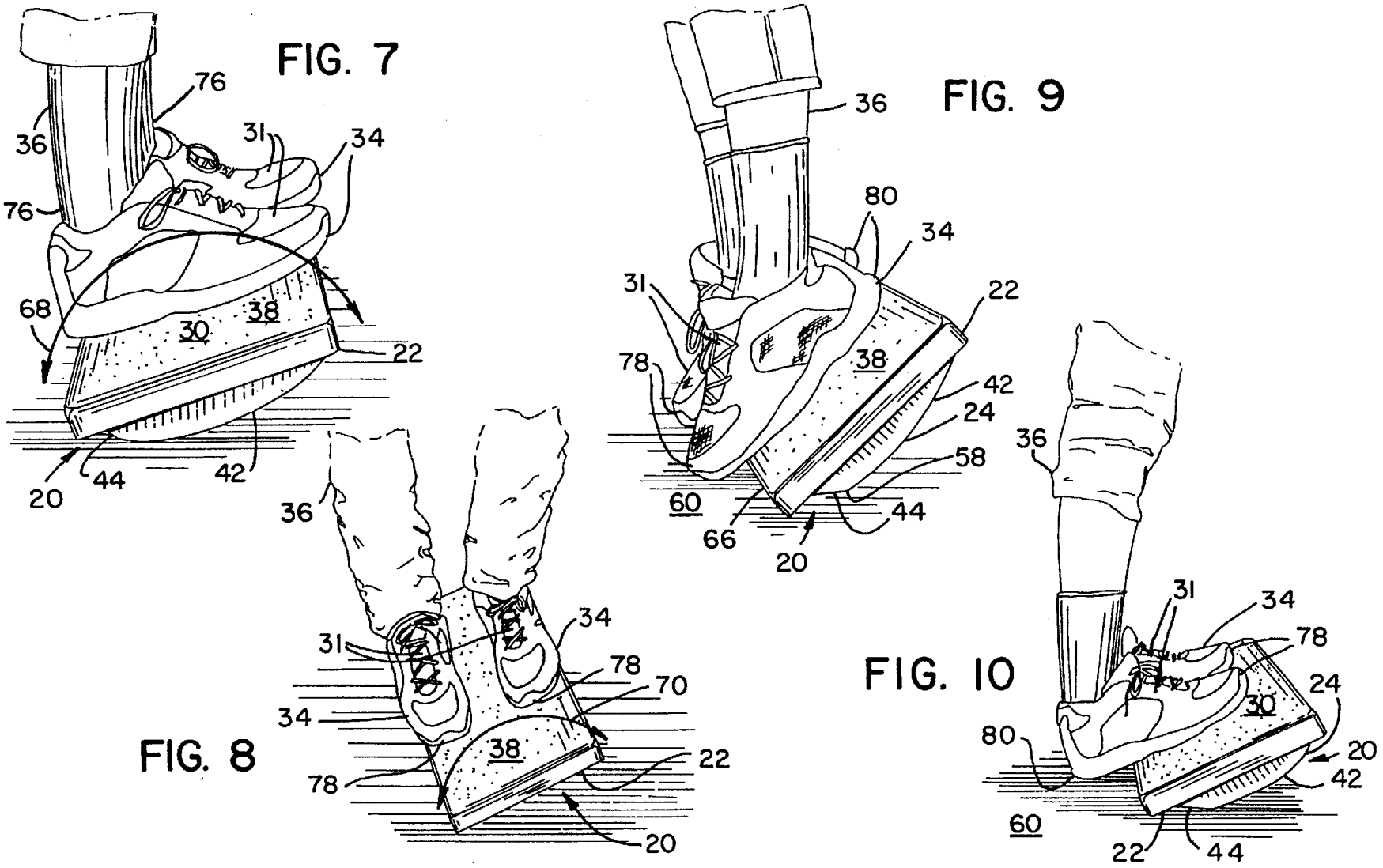
FIG. 7 is an isometric illustrative view of the rocker board of FIG. 1 showing a first exercise.
FIG. 8 is an isometric illustrative view of the rocker board of FIG. 1 showing a second exercise.
FIG. 9 is an isometric illustrative view of the rocker board of FIG. 1 showing a third exercise.
FIG. 10 is an isometric illustrative view of the rocker board of FIG. 1 showing a fourth exercise.
Figure 11:
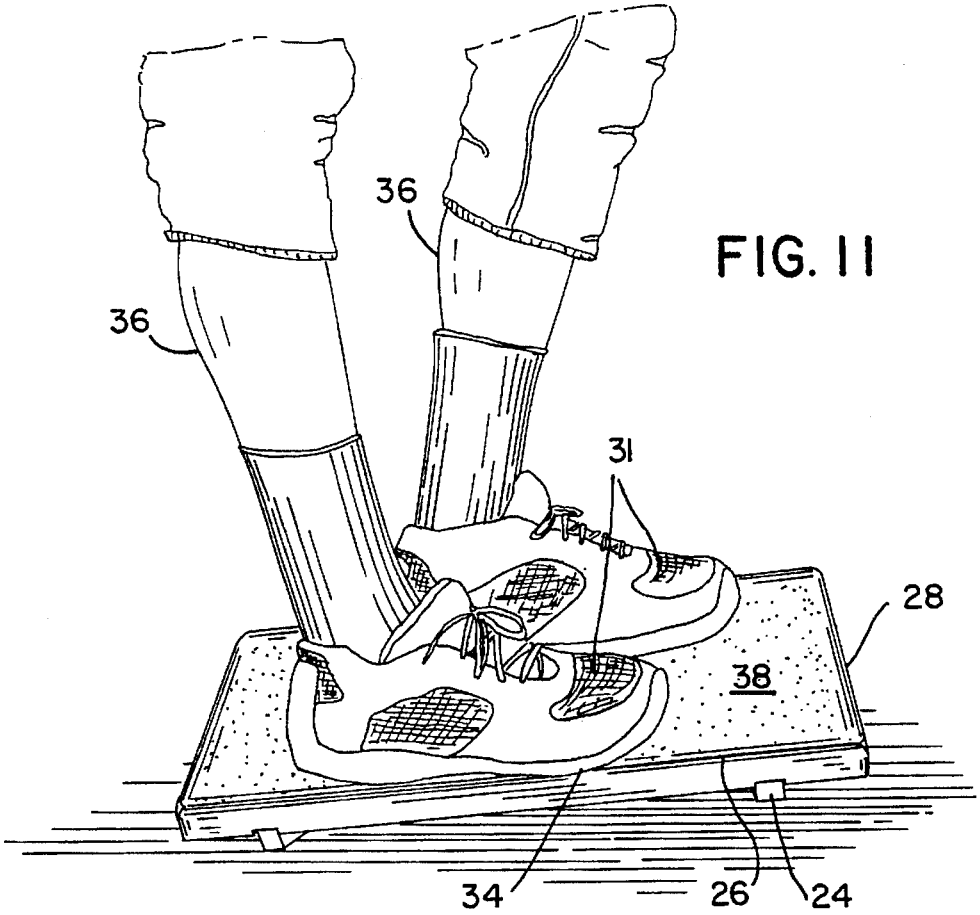
FIG. 11 is an isometric illustrative view of the rocker board of FIG. 1 showing a fifth exercise.

The exercise board 20 may be used to perform at least three types of exercises as shown in FIGS. 7, 8 and 11. In a rocking exercise, a person 36 stands on the upper surface 30 of the board 22 and, while grasping a stationary object, rocks back and forth on the board. In the exercises of FIGS. 7, 8 and 11, the smooth arcuate portion 42 of the rocker 24 allows the board to rock smoothly back and forth as illustrated by arrows 68 and 70. A second type of exercise is illustrated in FIGS. 9 and 10. In performing this exercise, the device 20 is positioned so that the flat portions 44 of the rockers 22 position the board at approximately a 45 degree angle with respect to the floor 60. While maintaining this static position, illustrated in FIGS. 9 and 10, a user may stretch the ligaments and muscles of the legs. A third form of exercise is illustrated in FIG. 12 wherein a bare or sock-clad foot 72 is positioned over the hemispherical projection 40 so the instep 74 of the foot 72 is positioned upon the apex 75 of the sphere. While the foot 72 is so positioned, it is gently urged against the projection 40 while the foot is relaxed. This helps relax the intrinsic muscles of the foot along with the plantar fascia.

The rocking exercises illustrated in FIGS. 7, 8 and 11 include standing on the board facing in the direction of the rockers 24 with the feet 31 substantially parallel to the short sides 28. The board 20 is then rocked forward and backward for about one minute with the ankles 76, not the knees, providing most of the motive action. This exercise can involve the anterior and posterior tibial muscles. On the other hand, when the feet 31 are placed perpendicular to the rockers 24 and parallel to the long sides 26 of the board 22 and the board is rocked back and forth with the shoes 34 kept flat on the board 22, an exercise is performed which stretches the talocalcaneal joint and the tensor fascialatae ligament.

In another exercise which involves rocking the exercise board 20, illustrated in FIG. 11, the person 36 stands lengthwise on the board, similar to the configuration illustrated in FIG. 8, with the feet 31 parallel to the long sides 26. The user's weight is shifted to one side and the body is rotated away from the lower leg for a period of about 30 seconds. This exercise, which involves bending the knees, can stretch the lower spine and open up the pelvis.

The flat portions 44 of the rockers may be used to position the board at a 45 degree angle to the floor 60. Either the toes 78 are elevated as shown in FIG. 10 or the heels 80 are elevated as shown in FIG. 9. These exercises are in the nature of static exercises in that the person 36 positions either the toes 78 or the heels 80 of their shoes 34 as far onto the board's upper surface 30 as possible without causing excessive discomfort. This position is then held for approximately one minute. Using the board, the exercises will typically be performed for a period of thirty seconds to one minute before moving on to another of the exercises illustrated in FIGS. 7–12.

Thus, the board 20 is useful in performing a number of exercises to increase the range of motion of the lower extremities and the lumbar-pelvic spine.

It should be understood that the board 22 and the rockers 24 may be constructed of wood, fiberglass, polyvinyl chloride (PVC), or other plastics, and may be fabricated by any number of techniques including injection molding, structural foam molding, thermoforming, blow molding, reaction injection molding, etc.

It should be understood that the board 22 may be formed of a grid or lattice work.

It should also be understood that the rockers 24 could be formed as two portions of a singles structure formed on the lower side of the board 22

It should also be understood that the protruding sphere 40, though preferably formed of a resilient closed cell foam such as that which a rubber softball is sometimes constructed of, could alternatively be co-formed with the board of rigid or semi-rigid plastic or the like.

Again, it will be understood that while the board is useful in performing various exercises, it should not be used by those who have a balance problem or who are taking alcohol or medication. Further, the proper use of the board requires the exercisers hold onto a stationary object while getting on and off and while using the board. It should also be understood the board may be used while standing or while seated.

It is understood that the invention is not limited to the particular construction and arrangement of parts herein illustrated and described, but embraces such modified forms thereof as come within the scope of the following claims.

I claim:

1. An exercise board for rocking on a floor comprising:

a) a rectangular board having an upper surface having a first short side and a second short side and two long sides, the upper surface providing a place upon which a person may stand for performing an exercise;

b) a first rocker connected beneath the board and closely spaced parallel to the first short side; and c) a second rocker connected beneath the board and closely spaced parallel to the second short side, and spaced from the first rocker, wherein each rocker has a lower profile for engaging the floor, and the lower profile of the first rocker is substantially the same as the lower profile of the second rocker, and wherein the lower profile has an arcuate portion which adjoins a planar portion at a ridge, wherein the arcuate portion extends along more than half the length of the rocker, and wherein the planar portion defines an angle of about 45° to the upper surface, so that when the exercise board is tilted to bring the planar portions of the rocker profiles into engagement with the floor the upper surface is held in a static position at an angle of about 45° to the floor and further comprising a substantially hemispherical projection which is fixed beneath the board which is spaced between the first rocker and the second rocker and wherein there is sufficient space around the projection for placing a foot over the projection to stretch the foot without interference with the first and second rockers.

2. The exercise board of claim 1 wherein the upper surface is textured by grit embedded in the upper surface of the board to create an increased coefficient of friction between the upper surface and a shoe positioned thereon.

3. An exercise board for use on a floor, the board for increasing the range of motion of the lower extremities and the lumbar-pelvic spine, the board comprising:

a) a means for engaging both feet of a standing person; and b) a first and second smoothly curved means for providing a rocking motion in a single plane mounted to the means for engaging; and c) a first and second means for supporting feet of a standing person at a fixed angle of about 45 degrees with respect to a floor, which adjoins the means for providing a rocking support at a first and second ridge, and further comprising a substantially hemispherical projection which is fixed beneath the means for engaging and is spaced between the first rocker and the second rocker and wherein there is sufficient space around the projection for placing a foot over the projection to stretch the foot without interference from the first and second smoothly curved means.

4. The exercise board of claim 3 wherein the means for engaging has an upper surface and wherein the upper surface is textured to create an increased coefficient of friction between a shoe and the upper surface.

* * * * *